US006076310A

United States Patent [19]

Kim

[11] Patent Number: 6,076,310

[45] Date of Patent: Jun. 20, 2000

[54] SYSTEM FOR DIVERTING WATER FROM AN EXTERIOR WINDOW FRAME

[76] Inventor: Jongil Kim, 10103 Residency Rd., Manassas, Va. 20110

[21] Appl. No.: 09/039,872

[22] Filed: Mar. 17, 1998

[51] Int. Cl.[7] ..... E04B 7/14

[52] U.S. Cl. ..... 52/97; 52/209; 52/302.6

[58] Field of Search ..... 52/13, 209, 255, 52/287.1, 288.1, 302.3, 302.6, 97

[56] References Cited

U.S. PATENT DOCUMENTS

| | | | |
|---|---|---|---|
| 349,894 | 9/1886 | McKenzie | 52/97 |
| 352,290 | 11/1886 | Bates | 52/97 |
| 993,861 | 5/1911 | McRonald | 52/97 |
| 1,346,742 | 7/1920 | Edmonds | 52/97 |
| 1,451,021 | 4/1923 | Hanson . | |
| 1,553,965 | 9/1925 | Thomas | 52/288.1 |
| 1,927,881 | 9/1933 | Wetmore | 52/97 |
| 1,950,519 | 3/1934 | Ripley | 52/97 |
| 1,976,116 | 10/1934 | Briggs . | |
| 2,397,803 | 4/1946 | Murray et al. | 52/209 X |
| 2,648,107 | 8/1953 | Bates, Jr. . | |
| 3,527,012 | 9/1970 | Hemminger | 52/97 X |
| 3,782,064 | 1/1974 | Hubbard et al. | 52/97 |
| 4,765,107 | 8/1988 | Ting | 52/302.3 X |
| 5,022,204 | 6/1991 | Anderson . | |
| 5,303,522 | 4/1994 | Vagedes | 52/97 |
| 5,307,597 | 5/1994 | Tanikawa et al. . | |
| 5,333,417 | 8/1994 | Demartini | 52/13 X |
| 5,586,415 | 12/1996 | Fisher et al. . | |
| 5,653,068 | 8/1997 | Moody et al. . | |

*Primary Examiner*—Richard Chilcot

[57] ABSTRACT

A device for diverting water flow along vertical side edges of an exterior window frame according to the present invention incoperates an upper mounting portion for fixedly attaching to a vertical side edge of an exterior window frame, and a lower deflecting portion fixedly formed along a lower portion of the upper mounting portion. The lower deflecting portion has an inwardly curved and tapered surface along which water to be diverted flows and is deflected outwardly. More specifically, in this embodiment, the upper mounting portion includes left and right side portions fixedly positioned at a right angle relative to each other, whereby the upper mounting portion is fixedly positionable within a corner recess of the vertical side edge of the window frame. In addition, the lower deflecting portion includes left and right side surfaces, each side surface having a radius of curvature defined such that the left and right side surfaces curve and taper inwardly, whereby water flowing along the lower deflecting portion is deflected outward and away from the window frame. The left and right side surfaces are fixedly positioned below the left and right side portions, respectively, of the upper mounting portion.

11 Claims, 3 Drawing Sheets

SYSTEM FOR DIVERTING WATER FROM AN EXTERIOR WINDOW FRAME

BACKGROUND OF THE INVENTION

1. Field of the Invention

The present invention is directed to a device for diverting the flow of water on and around an exterior window frame.

2. The Prior Art

Currently, when conventional exterior window frames are installed during the construction of a new home having a siding exterior, a siding panel S such as that shown in FIGS. 3A and 3B, will be cut in order to fit around the bottom side portion BS of an exterior window frame W. In order to prevent the possibility of rain water flowing down along the vertical side edges VE of the window and behind the siding panel S, caulking C is generally applied along the contact point P between the window frame W and the siding panel S.

However, Applicant has found that caulking often does not overcome the problem that it is intended to prevent. Sometimes, insufficient caulking may be applied during construction. Even if ample amounts of caulking are used, time and wear and tear on the house will eventually deteriorate the caulking. When caulking is incapable of preventing the entry of rain water, once the rain water does get behind the siding panel, it can seep through imperfections in the outer protective panels of the house, into the insulation of the house and even into the interior drywall. Over an extended period of time, even small amounts of rain water can eventually lead to water damage and fungal growth in the walls of the house. Further, since a considerable portion of the damage and deterioration would occur unseen at least until water damage to interior drywall became visible, the homeowner would have no opportunity to prevent its occurrence. By the time the damage is visible, all the homeowner can do is have portions of the exterior walls replaced, probably at considerable expense. Therefore, there exists a problem in that conventionally constructed exterior window frames in homes with siding panels cannot prevent the entry of rain water into the exterior walls, so as to prevent water damage.

Consequently, there exists a need in the industry for a system of preventing the entry of rain water into the exterior walls of a house around the exterior window frames, wherein the problem of water damage can be avoided.

SUMMARY OF THE INVENTION

The present invention is directed to addressing the problem of water damage to the exterior walls of a house having siding panels that surround exterior window frames by providing a structure and system that can prevent the occurrence of such problems.

Specifically, the present invention is directed to a device for diverting water flow along vertical side edges of an exterior window frame. Generally, the device incorporates an upper mounting portion for fixedly attaching to a vertical side edge of an exterior window frame, and a lower deflecting portion fixedly formed along a lower portion of the upper mounting portion. The lower deflecting portion has an inwardly tapered surface along which water to be diverted flows and is deflected outwardly. In a preferred embodiment, the deflecting portion has an inwardly curved and tapered surface.

More specifically, in this aspect, the upper mounting portion includes left and right side portions fixedly positioned at a right angle relative to each other, whereby the upper mounting portion is fixedly positionable within a corner recess of the vertical side edge of the window frame. In addition, in the preferred embodiment, the lower deflecting portion includes left and right side surfaces, each side surface having a radius of curvature defined such that the left and right side surfaces curve and taper inwardly, whereby water flowing along the lower deflecting portion is deflected outward and away from the window frame. The left and right side surfaces are fixedly positioned below the left and right side portions, respectively, of the upper mounting portion.

In another aspect, the present invention is directed to a system for diverting water flow along vertical side edges of an exterior window frame, wherein the system incorporates an exterior window frame having first and second vertical side edges, and first and second deflecting portions fixedly formed along the first and second vertical side edges of the window frame. Each of the first and second deflecting portions has an inwardly tapered surface along which water to be diverted flows and is deflected outwardly. In a preferred embodiment of this aspect, each of the first and second deflecting portions has an inwardly curved and tapered surface.

BRIEF DESCRIPTION OF THE DRAWINGS

The present invention will be described herein below in conjunction with the accompanying drawings illustrating the invention, wherein:

FIG. 2B is a partial cutaway right side view of a lowermost portion of the window frame with the present invention.

DETAILED DESCRIPTION OF THE PREFERRED EMBODIMENTS

Figure 1:
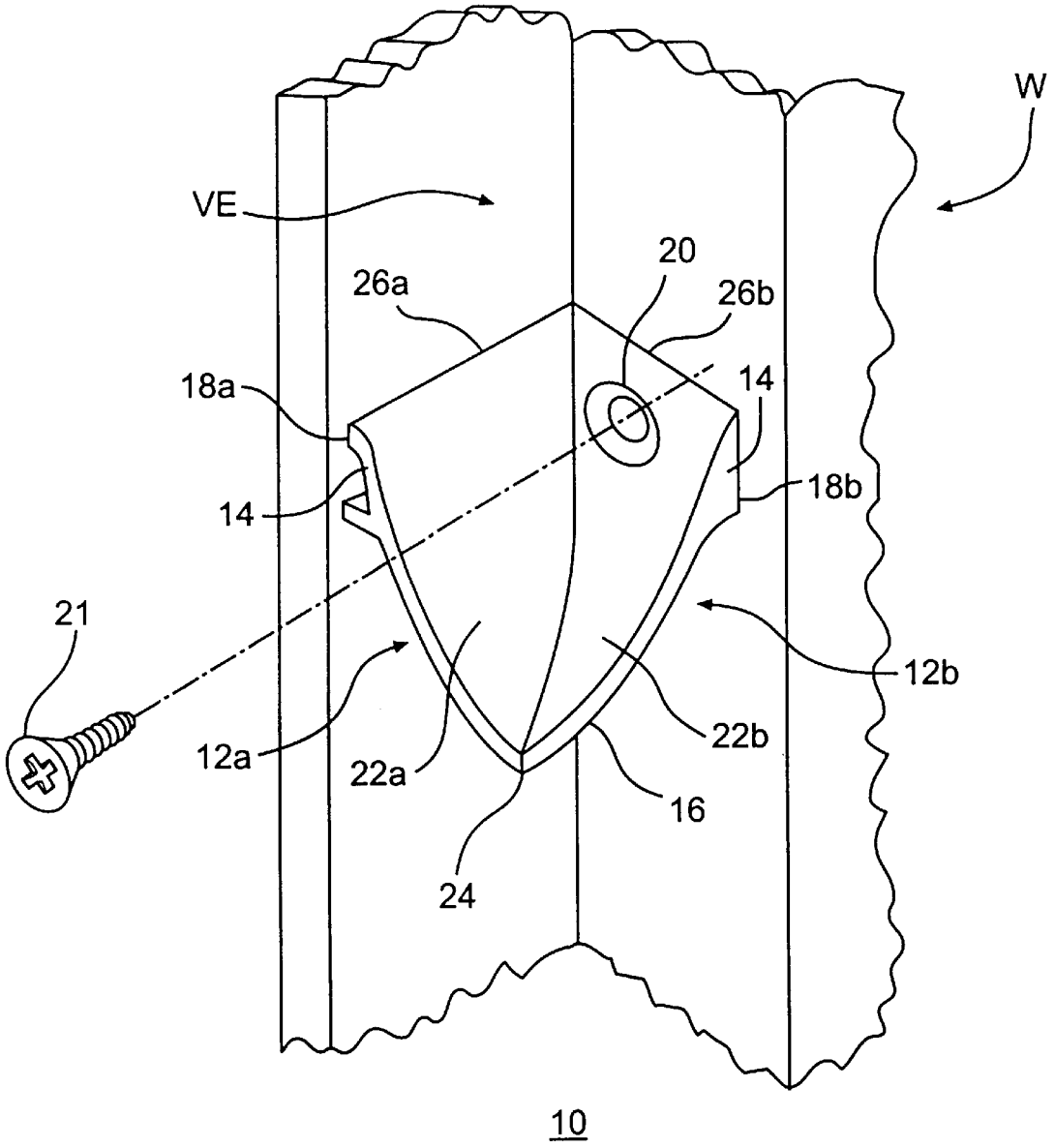
FIG. 1 illustrates a partial cutaway view of a window frame showing a perspective view of the main embodiment of the present invention.

With reference to the figures, like reference characters will be used to indicate like elements throughout the several embodiments and views thereof. In particular, with reference to FIGS. 1, 2A and 2B, the present invention is directed to a water diverter device 10 having left and right surface portions 12*a*,12*b* that are positioned at a right angle (90°) to each other, whereby the device 10 can be positioned within a corner recess of the vertical side edge VE of an exterior window frame W.

Each of the left and right surface portions 12*a*,12*b* are then formed into an upper mounting portion 14 and a lower water flow deflecting portion 16. The upper mounting portion 14 is formed so as to provide structural support for the device 10. As such, the back surface portion portions 18*a*, 18*b* of the upper mounting portion 14 so as to contact relatively flush with a corresponding corner wall surface or recess of the vertical side edge VE of the window frame W. In addition, either the left or right surface portion 12*a*, 12*b* has a mounting hole 20 defined through it so that a mounting screw or nail 21 can fixedly hold the device 10 against the window frame W.

In this main embodiment, the mounting hole 20 is defined in the right surface portion 12*b*, whereby the mounting screw 21 is screwed into the side of window frame W and not towards the siding or wall of the house when the device 10 is attached to the left vertical edge portion of the window frame W. If the device 10 were attached to the right vertical edge portion of the window frame W, a mirror image version of the device 10 would used such that the mounting hole would be defined on the left surface portion and the mounting screwed would be screwed into the window frame.

The upper edges 26*a*,26*b* of the left and right surface portions 12*a*, 12*b*, respectively, are formed with outward taper edges so that water flowing down the vertical side edge VE will smoothly flow into the lower deflecting portion 16 and away from the window frame W.

In the lower deflecting portion 16, the left and right surface portions 12*a*, 12*b* are curved and tapered inward to form the left and right side surfaces 22*a*,22*b* of a sloped deflecting portion 22. Each of the left and right side surfaces 22*a*,22*b* has a radius of curvature selected such that the lowermost corner of the sloped deflecting portion 22 ends at a point 24. The overall outer size, dimensions and shape of the device 10 is selected so that the device 10 may be mounted with a recess of the vertical side edge VE of the window frame W without interfering with the placement or location of other window frame components or even adjacent window frames.

In the preferred embodiment of the present invention, the device 10 may be formed from any known homebuilding material capable of accommodating the subtle lines and curves that form the sloped deflecting portion 22 and the upper edges 26*a*,26*b*. This includes any material that can be molded, pressed or carved, such as PVC plastic, other types of vinyl, aluminum, rubber, wood, and stainless steel or other metals. The device 10 is fixedly attached to the window frame W via the mounting hole 20 using a conventional screw, nail, tack or other known mounting elements. Alternatively, the device 10 may be mounted using other known techniques for attaching components together including adhesives, so long as the water flow from the vertical side edge VE of the window frame W into the device 10 is not obstructed or compromised, and the device 10 can withstand repeated or continuous flow of water without prematurely breaking off from the window frame.

As a specific example of the size and dimensions of the present invention, in the main embodiment, the left side portion 12*a* of the device is 21.5 mm wide along its upper edge 26*a*, while the right side portion 12*b* is 17 mm wide along its upper edge 26*b*. The height of the device 10 is approximately 24.5 mm from the lowermost portion of the point 24 to the upper edges 26*a*,26*b*. The radius of curvature of the left side surface 22*a* of the sloped deflecting portion 22 is 24 mm, while the radius of curvature of the right side surface 22*b* is 19.3 mm. While the above-discussed dimensions of the present invention are applicable to the main embodiment, variations in those dimensions are possible and within the understanding of one of skill in the art given the disclosure of the present invention. Such variations will be the result of the demands of the particular application of the present invention.

For example, in the lower deflecting portion 16, the left and right surface portions 12*a*, 12*b* may be tapered inward to form the left and right side surfaces 22*a*,22*b* of the sloped deflecting portion 22, but without a curved surface. Rather, the left and right side surfaces 22*a*,22*b* may be flat and sloped downward.

Figure 2A:
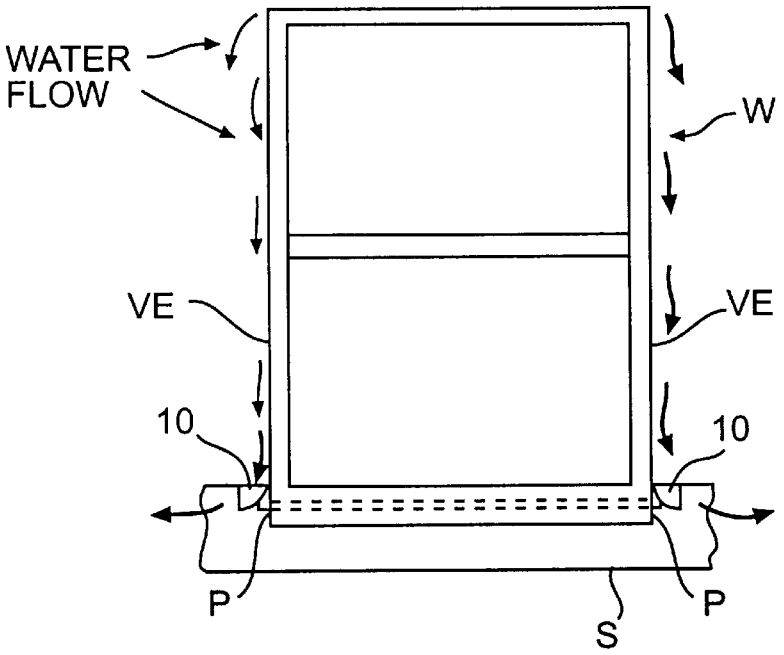
FIGS. 2A and 2B illustrate the application and operation of the present invention to an exterior window frame, wherein FIG. 2A shown a front view of a window frame incorporating the present invention
Figure 2B:
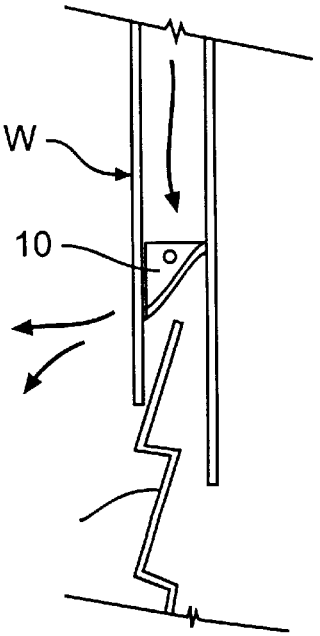
Figure 3A:
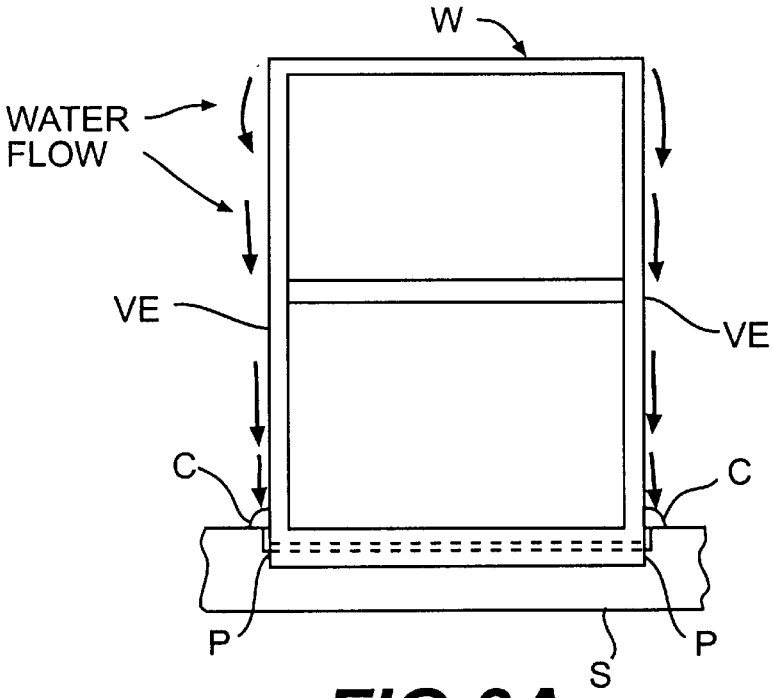
FIG.3A PRIOR ART
FIGS. 3A and 3B show the structure of a conventionally equipped and constructed exterior window frame wherein FIG. 3A shown a front view of a conventionally installed window frame and FIG. 3B is a partial cutaway right side view of a lowermost portion of the window frame.
Figure 3B:
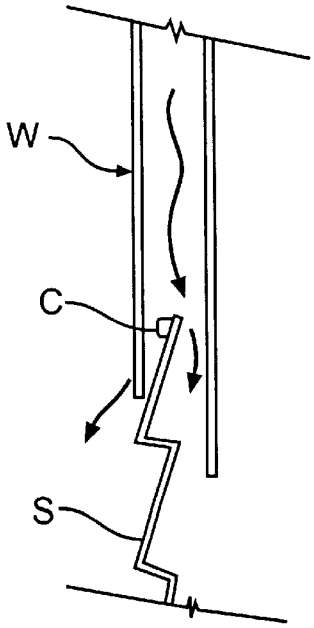
FIG.3B PRIOR ART

In the application or operation of the present invention, as shown in FIGS. 2A and 2B, a device 10 is mounted on both sides of a window frame W along the lowermost portion of the window frame's vertical side edges VE. When water flows down from the top of the window frame W and along the vertical side edges VE, such as when rain occurs, the water will flow from the vertical side edges and into the devices 10. Specifically, water will be diverted onto the upper edges 26*a*,26*b* and into the sloped deflecting portion 22. The curvature of the sloped deflecting portion 22 will in turn direct the flow of water away from the window frame and the surrounding siding panels. As a result, water is prevented from entering through any area surrounding the window frame.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A device for diverting water flow along vertical side edges of an exterior window frame, the device comprising:

an upper mounting portion for fixedly attaching to a vertical side edge of an exterior window frame; and a lower deflecting portion fixedly formed along a lower portion of the upper mounting portion, said lower deflecting portion having an inwardly curved and tapered surface along which water to be diverted flows and is deflected outwardly.

2. A device according to claim 1, wherein said upper mounting portion includes left and right side portions fixedly positioned at a right angle relative to each other, whereby said upper mounting portion is fixedly positionable within a corner recess of the vertical side edge of the window frame.

3. A device according to claim 2, wherein said lower deflecting portion includes left and right side surfaces, each side surface having a radius of curvature defined such that the left and right side surfaces curve and taper inwardly, whereby water flowing along said lower deflecting portion is deflected outward and away from the window frame, and said left and right side surfaces are fixedly positioned below said left and right side portions, respectively, of said upper mounting portion.

4. A system for diverting water flow along vertical side edges of an exterior window frame, the system comprising:

an exterior window frame having first and second vertical side edges; and first and second deflecting portions fixedly formed along said first and second vertical side edges of said window frame, each of said first and second deflecting portions having an inwardly curved and tapered surface along which water to be diverted flows and is deflected outwardly.

5. A system according to claim 4, wherein said first and second deflecting portions are fixedly positioned at lower ends of said first and second vertical side edges, respectively, of said window frame.

6. A system according to claim 4, wherein each of said first and second deflecting portions includes left and right side surfaces, each side surface having a radius of curvature defined such that the first and second side surfaces curve and taper inwardly, whereby water flowing along said first and second deflecting portions is deflected outward and away from said window frame.

7. A device for diverting water flow along vertical side edges of an exterior window frame, the device comprising:

an upper mounting portion for fixedly attaching to a vertical side edge of an exterior window frame; and a lower deflecting portion fixedly formed along a lower portion of the upper mounting portion, said lower deflecting portion having an inwardly tapered surface along which water to be diverted flows and is deflected outwardly.

8. A device according to claim 7, wherein said upper mounting portion includes left and right side portions fixedly positioned at a right angle relative to each other, whereby said upper mounting portion is fixedly positionable within a comer recess of the vertical side edge of the window frame.

9. A device according to claim 2, wherein said lower deflecting portion includes left and right side surfaces that taper inwardly and downwardly, whereby water flowing along said lower deflecting portion is deflected outward and away from the window frame, and said left and right side surfaces are fixedly positioned below said left and right side portions, respectively, of said upper mounting portion.

10. A system for diverting water flow along vertical side edges of an exterior window frame, the system comprising:

an exterior window frame having first and second vertical side edges; and first and second deflecting portions fixedly formed along said first and second vertical side edges of said window frame, each of said first and second deflecting portions having an inwardly tapered surface along which water to be diverted flows and is deflected outwardly.

11. A system according to claim 10, wherein said first and second deflecting portions are fixedly positioned at lower ends of said first and second vertical side edges, respectively, of said window frame.

* * * * *